US009033331B2

(12) United States Patent
Arimura et al.

(10) Patent No.: US 9,033,331 B2
(45) Date of Patent: May 19, 2015

(54) IMAGE FORMING APPARATUS

(71) Applicant: KYOCERA Document Solutions Inc., Osaka-shi, Osaka (JP)

(72) Inventors: Shingo Arimura, Osaka (JP); Eiji Tatsumi, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 14/314,739

(22) Filed: Jun. 25, 2014

(65) Prior Publication Data

US 2015/0001793 A1 Jan. 1, 2015

(30) Foreign Application Priority Data

Jun. 27, 2013 (JP) ..... 2013-134636

(51) Int. Cl.

*B65H 3/44* (2006.01)
*B65H 1/08* (2006.01)
*B65H 9/00* (2006.01)

(52) U.S. Cl.

CPC .. *B65H 1/08* (2013.01); *B65H 9/00* (2013.01); *B65H 3/44* (2013.01); *B65H 2405/332* (2013.01)

(58) Field of Classification Search

CPC ..... B65H 3/44; B65H 2405/332; B65H 1/08; B65H 9/00
USPC ..... 271/9.08, 9.11, 9.13, 162
See application file for complete search history.

(56) References Cited

U.S. PATENT DOCUMENTS

| | | | | |
|---|---|---|---|---|
| 5,155,537 | A * | 10/1992 | Komatsu et al. | 399/391 |
| 7,621,519 | B2 * | 11/2009 | Sagawa et al. | 271/4.01 |
| 7,871,067 | B2 * | 1/2011 | Lim | 271/9.13 |
| 8,434,755 | B2 * | 5/2013 | Imai | 271/9.13 |
| 8,807,739 | B2 * | 8/2014 | Okamoto | 347/104 |
| 2008/0203649 | A1 * | 8/2008 | Watase et al. | 271/9.13 |
| 2012/0235345 | A1 * | 9/2012 | Shiota | 271/9.11 |
| 2013/0038014 | A1 * | 2/2013 | Yoshida | 271/9.11 |
| 2013/0207335 | A1 * | 8/2013 | Nishioka et al. | 271/9.11 |

FOREIGN PATENT DOCUMENTS

| | | |
|---|---|---|
| JP | 2000-7184 | 1/2000 |

* cited by examiner

*Primary Examiner* — David H Bollinger
(74) *Attorney, Agent, or Firm* — Gerald E. Hespos; Michael J. Porco; Matthew T. Hespos

(57) ABSTRACT

An image forming apparatus includes an apparatus main body with a main conveyance path, a first storage portion including a first conveyance path, a second conveyance path and a joint section. The joint section is a part where an upstream end of the main conveyance path and downstream ends of the first and second conveyance paths join. The first storage portion includes a movable guide at the position of the downstream end of the first conveyance path. The movable guide is displaced to a projecting position where the movable guide projects toward the joint section from the downstream end of the first conveyance path to guide the sheet in a state where the first storage portion is mounted in the apparatus main body and a retracted position substantially retracted from the joint section in a state where the first storage portion is withdrawn from the apparatus main body.

7 Claims, 11 Drawing Sheets

IMAGE FORMING APPARATUS

This application is based on Japanese Patent Application No. 2013-134636 filed with the Japan Patent Office on Jun. 27, 2013, the contents of which are hereby incorporated by reference.

BACKGROUND

The present disclosure relates to an image forming apparatus with a joint section where a plurality of sheet conveyance paths join.

In an image forming apparatus for forming an image on a sheet, cassettes for storing sheets may be mounted in a plurality of levels in an apparatus main body. In this case, a main conveyance path passing through an image forming unit for transferring an image to a sheet, a first conveyance path leading to the main conveyance path from an upper cassette and a second conveyance path leading to the main conveyance path from a lower cassette are formed in the apparatus main body. A joint section is formed between an upstream end of the main conveyance path and downstream ends of the first and second conveyance paths.

SUMMARY

An image forming apparatus according to one aspect of the present disclosure includes an apparatus main body, a first storage portion, a second conveyance path and a joint section. The apparatus main body includes an image forming unit for applying an image forming process to a sheet and a main conveyance path for conveying the sheet by way of the image forming unit. The first storage portion is withdrawably mounted into the apparatus main body and includes a storage portion for sheets and a first conveyance path for conveying the sheet from the storage portion toward the main conveyance path. The second conveyance path conveys a sheet from a second storage portion for sheets other than the first storage portion toward the main conveyance path. The joint section is a part where an upstream end of the main conveyance path and downstream ends of the first and second conveyance paths join, and a conveyance width in a thickness direction of sheets to be conveyed is wider than the first conveyance path.

The first storage portion includes a movable guide at the position of the downstream end of the first conveyance path for guiding a sheet. The movable guide is displaced to a projecting position where the movable guide projects toward the joint section from the downstream end of the first conveyance path to guide the sheet in a mounted state where the first storage portion is mounted in the apparatus main body and a retracted position substantially retracted from the joint section in a withdrawn state where the first storage portion is withdrawn from the apparatus main body.

These and other objects, features and advantages of the present disclosure will become more apparent upon reading the following detailed description along with the accompanying drawings.

DETAILED DESCRIPTION

Figure 1:
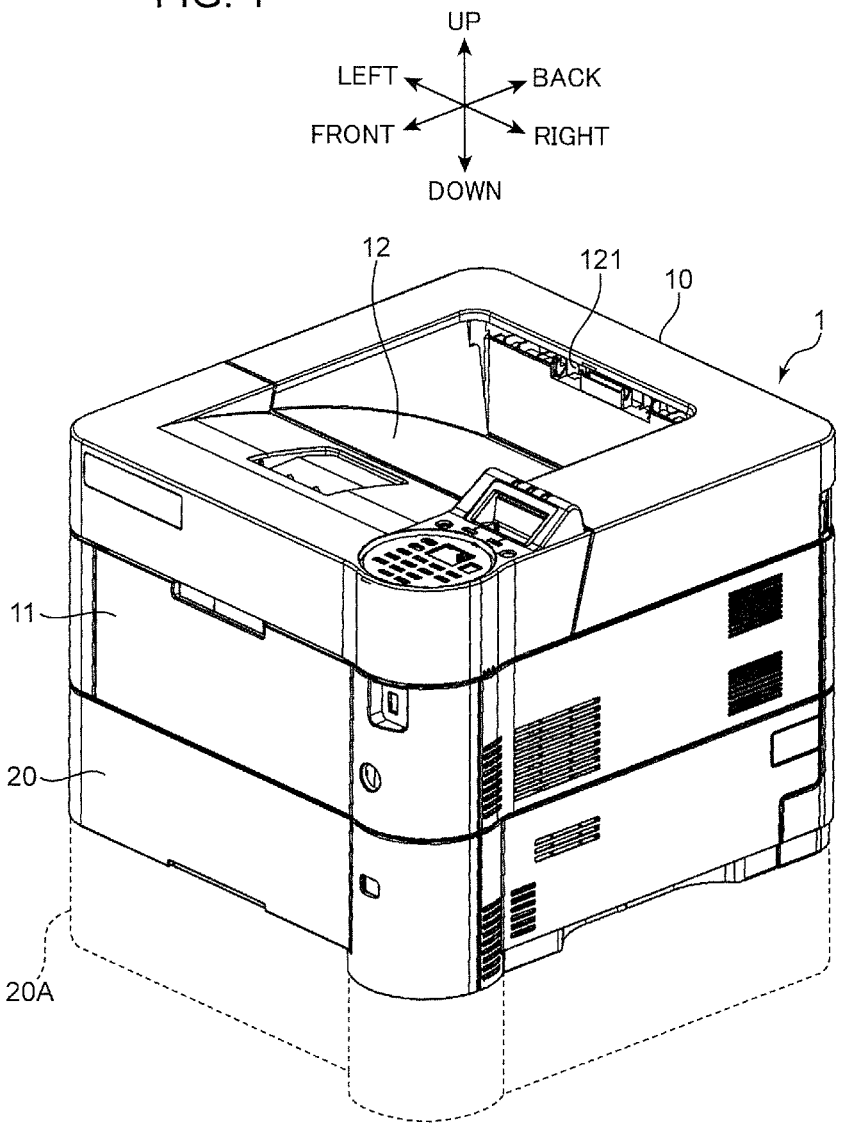
FIG. 1 is a perspective view of an image forming apparatus according to an embodiment of the present disclosure.
Figure 2:
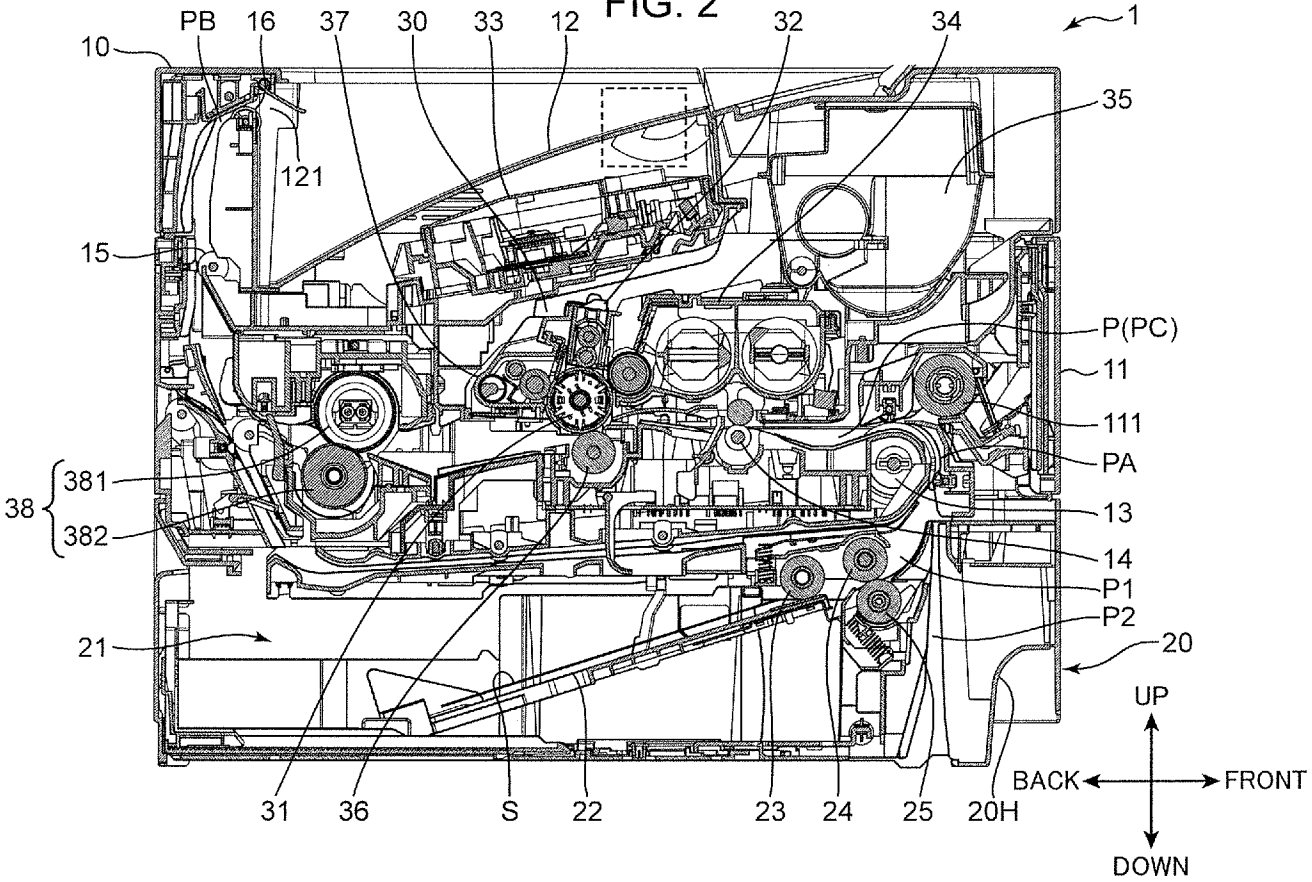
FIG. 2 is a sectional view showing the internal structure of the image forming apparatus.

Hereinafter, one embodiment of the present disclosure is described with reference to the drawings. FIG. 1 is a perspective view of a printer 1 (image forming apparatus) according to the embodiment of the present disclosure, and FIG. 2 is a sectional view showing the internal structure of the printer 1. Although the printer 1 shown in FIGS. 1 and 2 is a so-called monochrome printing machine, the image forming apparatus may be a color printer, a facsimile machine, a complex machine provided with these functions or another apparatus for forming a toner image on a sheet.

The printer 1 includes a main body housing 10 (apparatus main body) for housing various devices for forming an image on a sheet S. The main body housing 10 includes a manual feed tray 11 on the front surface thereof and a discharge tray 12 on the upper surface thereof. The discharge tray 12 is a tray for receiving the sheet S after an image forming process discharged from a sheet discharge opening 121 of the main body housing 10. A cassette 20 (first storage portion) for storing sheets S to be used for image formation is so mounted in a lower part of the main body housing 10 as to be withdrawable forward from the front surface of the main body housing 10. Further, as shown in dotted line in FIG. 1, an additional cassette 20A (second storage portion) can be attached below the cassette 20.

An image forming unit 30 (image forming unit) for transferring a toner image to a sheet S and a fixing unit 38 for fixing the toner image to the sheet S are housed in the main body housing 10. Further, a main conveyance path P for conveying the sheet S to the discharge tray 12 by way of the image forming unit 30 and the fixing unit 38 is provided in the main body housing 10.

The image forming unit 30 includes a photoconductive drum 31 and a charging device 32, an exposure device 33, a developing device 34, a transfer roller 36 and a cleaning device 37 arranged around this photoconductive drum 31. The photoconductive drum 31 rotates about its shaft and has a circumferential surface on which an electrostatic latent image and a toner image are to be formed. The charging device 32 uniformly charges the circumferential surface of the photoconductive drum 31. The exposure device 33 irradiates laser light to the circumferential surface of the photoconductive drum 31 to form an electrostatic latent image. The developing device 34 supplies toner to the circumferential surface of the photoconductive drum 31 to develop the electrostatic latent image formed on the photoconductive drum 31. A toner container 35 for supplying the toner to the developing device 34 is arranged above the developing device 34. The transfer roller 36 forms a transfer nip portion together with the photoconductive drum 31 to transfer a toner image on the photoconductive drum 31 to a sheet S. The cleaning device 37 cleans the circumferential surface of the photoconductive drum 31 after the transfer of the toner image.

The fixing unit 38 includes a fixing roller 381 with a built-in heat source and a pressure roller 382 forming a fixing nip portion together with the fixing roller 381.

The main conveyance path P includes an upstream end PA located near the front end of the main body housing 10 and a downstream end PB located near the rear upper end of the main body housing 10. The main conveyance path P is a conveyance path extending vertically near the upstream end PA and the downstream end PB and substantially horizontally in a front-back direction in an intermediate portion PC. A manual feed roller 111, a conveyor roller 13 and a pair of registration rollers 14 are arranged upstream of the image forming unit 30 and a pair of conveyor rollers 15 and a pair of discharge rollers 16 are arranged downstream of the fixing unit 38 in the main conveyance path P.

The manual feed roller 111 feeds a sheet placed on the manual feed tray 11 to the vicinity of the upstream end PA of the main conveyance path P. The conveyor roller 13 conveys the sheet S toward the transfer nip portion of the image forming unit 30. The pair of registration rollers 14 corrects the skew of the sheet S and feeds the sheet S to the transfer nip portion at a predetermined timing. The pair of conveyor rollers 15 convey the sheet S after a fixing process toward the sheet discharge opening 121. The pair of discharge rollers 16 discharge the sheet S from the sheet discharge opening 121 to the discharge tray 12.

The cassette 20 includes a sheet storage portion 21 for storing a plurality of sheets S and a lift plate 22 for supporting the sheets S to lift up the front ends of the sheets S. A pickup roller 23 for picking up the uppermost sheet of a sheet stack stored in the sheet storage portion 21 one by one, a feed roller 24 for feeding the sheet S to the upstream end PA of the main conveyance path P and a retard roller 25 forming a feed nip portion together with the feed roller 24 are provided near an upper part of the front end of the sheet storage portion 21. The cassette 20 further includes a first conveyance path P1 for conveying the sheet S to the upstream end PA of the main conveyance path P from the sheet storage portion 21 and a second conveyance path P2 for conveying the sheet S to the upstream end PA of the main conveyance path P from the additional cassette 20A.

Figure 3:
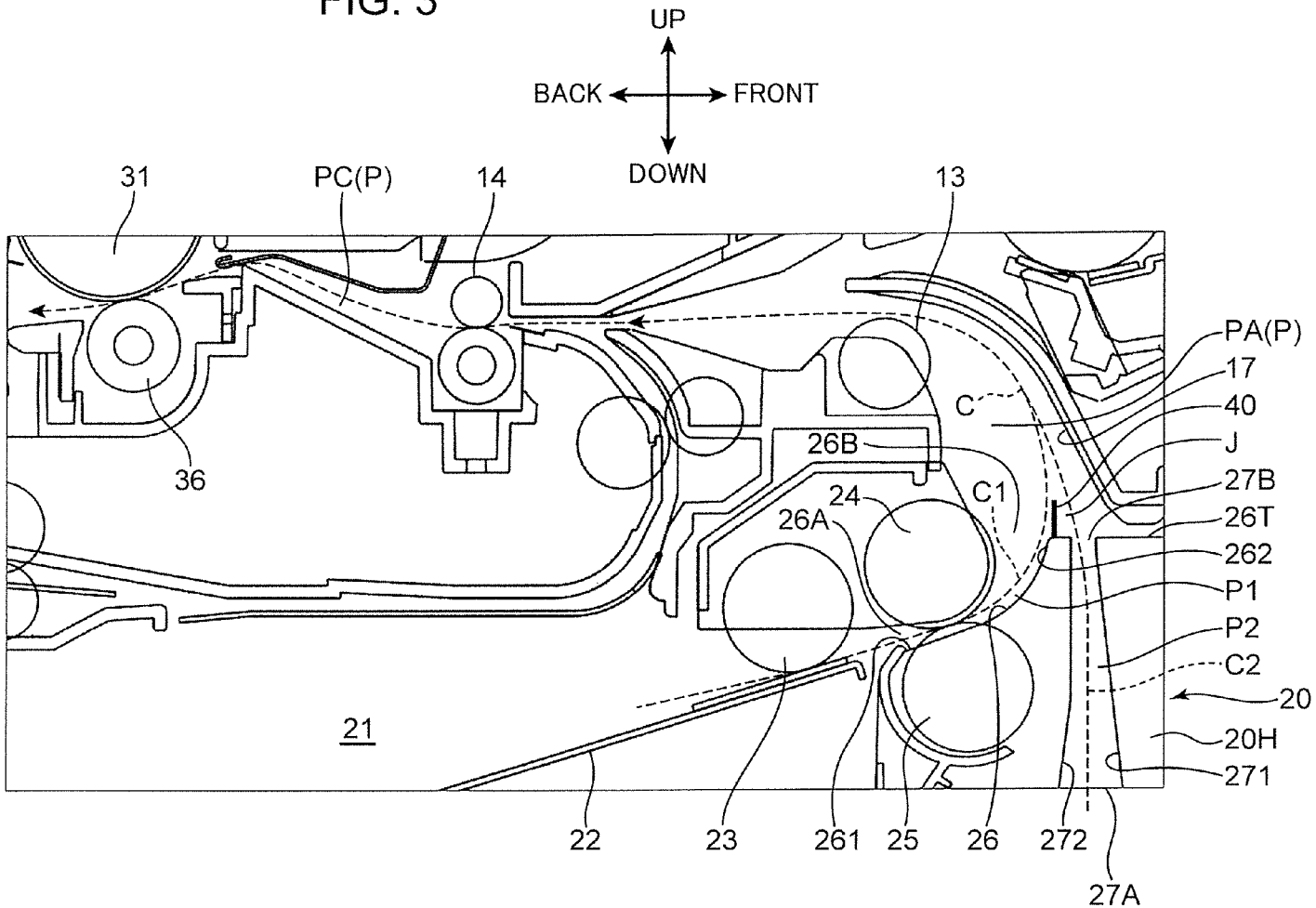
FIG. 3 is an enlarged sectional view of an essential part of the image forming apparatus.

FIG. 3 is a sectional view enlargedly showing the vicinity of the feed roller 24 of the cassette 20. The first conveyance path P1 is provided in a cassette housing 20H located before the sheet storage portion 21 and extends obliquely upward from a rear side to a front side. An upstream end 26A of the first conveyance path P1 faces the front end of the sheet storage portion 21 and a downstream end 26B is arranged on a ceiling plate 26T of the cassette housing 20H. The lower surface of the first conveyance path P1 is defined by a curved guide plate 26 curved upward from a substantially horizontal direction, an upstream edge 261 of the curved guide plate 26 is the upstream end 26A of the first conveyance path P1 and a downstream edge 262 thereof is the downstream end 26B.

The second conveyance path P2 is a conveyance path vertically extending through the cassette housing 20H and defined by a pair of vertical guide plates 271, 272 arranged at a distance from each other in the cassette housing 20H. An upstream end 27A of the second conveyance path P2 is an opening provided on a bottom plate of the cassette housing 20H and a downstream end 27B of the second conveyance path P2 is an opening provided on the ceiling plate 26T of the cassette housing 20H. Note that the second conveyance path P2 is a conveyance path which is not used when the additional cassette 20A is not attached to the main body housing 10. Further, when the additional cassette 20A is attached, an actual upstream end of the second conveyance path P2 is a conveyance path near a feed roller included in the additional cassette 20A. The downstream end 26B of the first conveyance path P1 and the downstream end 27B of the second conveyance path P2 are juxtaposed in a withdrawing direction (forward direction) of the cassette 20 on the ceiling plate 26T.

The printer 1 includes a joint section J in a part where the upstream end PA of the main conveyance path P and the downstream ends 26B, 27B of the first and second conveyance paths P1, P2 join. A sheet being conveyed by way of a conveyance path C1 in the first conveyance path P1 is conveyed along a conveyance path C in the main conveyance path P by way of this joint section J. Further, a sheet being conveyed by way of a conveyance path C2 in the second conveyance path P2 is also similarly conveyed along the conveyance path C in the main conveyance path P by way of this joint section J. As is understood from FIG. 3, the conveyance path C1 to C from the first conveyance path P1 to the vicinity of the upstream end PA of the main conveyance path P is a conveyance path curved into a substantially L shape. Contrary to this, the conveyance path C2 to C from the second conveyance path P2 to the vicinity of the upstream end PA of the main conveyance path P is a vertically extending conveyance path.

Conveyance widths of the first and second conveyance paths P1, P2 in a thickness direction of sheets to be conveyed are set at predetermined widths capable of appropriately conveying the sheets. On the other hand, the joint section J has a conveyance width capable of facing both the downstream end 26B of the first conveyance path P1 and the downstream end 27B of the second conveyance path P2. That is, the downstream ends 26B, 27B are juxtaposed at a distance from each other in the front-back direction on the ceiling plate 26T and the joint section J has a conveyance width capable of covering both of these downstream ends 26B, 27B. Thus, the conveyance width of the joint section J is considerably wider than the conveyance width of the first conveyance path P1. That is, in the conveyance path C1 to C, the conveyance width is suddenly enlarged upon the exit from the downstream end 26B.

If the second conveyance path P2 is not provided, the joint section J is not necessary. In this case, an outer guide plate 17 defining an outer guide surface near the upstream end PA of the main conveyance path P can be held substantially flush with the curved guide plate 26 defining an outer guide surface of the first conveyance path P1, whereby the conveyance width can be made substantially constant. However, since the downstream end 27B of the second conveyance path P2 is arranged before the downstream end 26B in this embodiment, it is necessary to connect the joint section J to the downstream end 26B and enlarge the conveyance width toward the front side. This causes a problem that the trailing end of the sheet being conveyed along the conveyance path C1 to C flips up in the joint section J.

Figure 4:
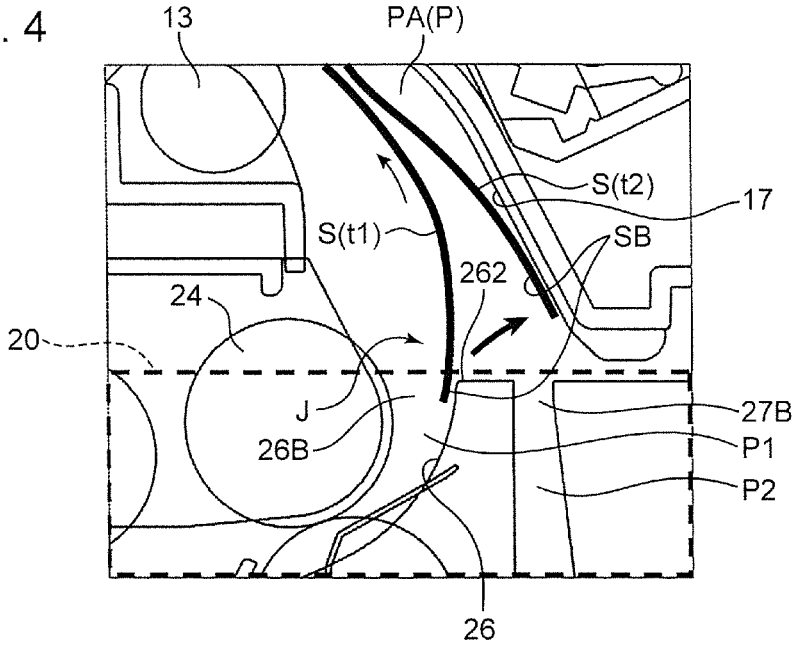
FIG. 4 is a sectional view showing the flip-up of a sheet trailing end in a joint section of first and second conveyance paths.
Figure 5:
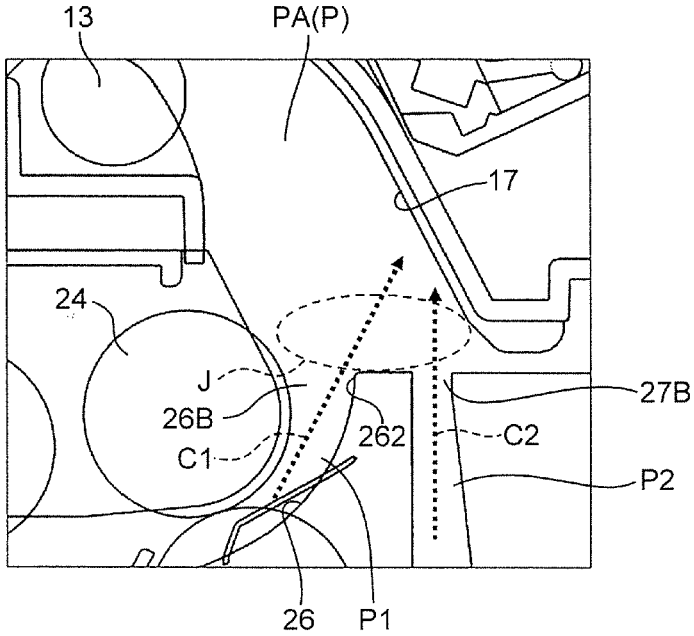
FIG. 5 is a sectional view showing the joint section.

FIG. 4 is a sectional view showing the flip-up of a trailing end SB of the sheet S in a conveying direction in the joint section J, and FIG. 5 is a sectional view showing the joint section J. The sheet S dispensed from the first conveyance path P1 is carried into the upstream end PA of the main conveyance path P through the joint section J. At time t1 immediately before the trailing end SB of the sheet S passes through the downstream end 26B of the first conveyance path P1, the trailing end SB is guided by the downstream edge 262 of the curved guide plate 26 (see S(t1) of FIG. 4).

Contrary to this, at time t2 at which the trailing end SB of the sheet S passes through the downstream end 26B and reaches the joint section J, the trailing end SB flips up toward the outer guide plate 17 (see S(t2) of FIG. 4). In this embodiment, a conveyance path extending from the first conveyance path P1 to an intermediate part PC via the upstream end PA of the main conveyance path P is curved into a U shape convex toward the front side. That is, the leading end of the sheet S being conveyed along the conveyance path C1 to C in the conveying direction is nipped by the pair of registration rollers 14 and the trailing end SB in the conveying direction is nipped in the feed nip portion between the feed roller 24 and the retard roller 25, whereby the sheet S is conveyed toward a downstream side of the main conveyance path P in a state curved into the U shape.

As the sheet S is further conveyed and the trailing end SB passes through the feed nip portion, the trailing end SB is conveyed while being pressed against the curved guide plate 26 due to a restoring force based on a force of the sheet S for restoration from the curved state to a flat state. When the trailing end SB passes through the downstream end 26B and reaches the joint section J, the pressing force is released at once and the trailing end SB flips up forward. Due to this flip-up, the trailing end SB strongly collides with the downstream edge 262 to produce a large flipping sound.

As shown in FIG. 5, it is essential to provide the joint section J to ensure not only the conveyance path C1 for sheets to be carried into the main conveyance path P from the first conveyance path P1, but also the conveyance path C2 for sheets to be carried into the main conveyance path P from the second conveyance path P2, and the conveyance width of the joint section J cannot be narrowed. Further, the printer 1 is small in size and there is no spatial margin for mounting a conventional switch guide or the like in the main body housing 10 near the joint section J.

Figure 6:
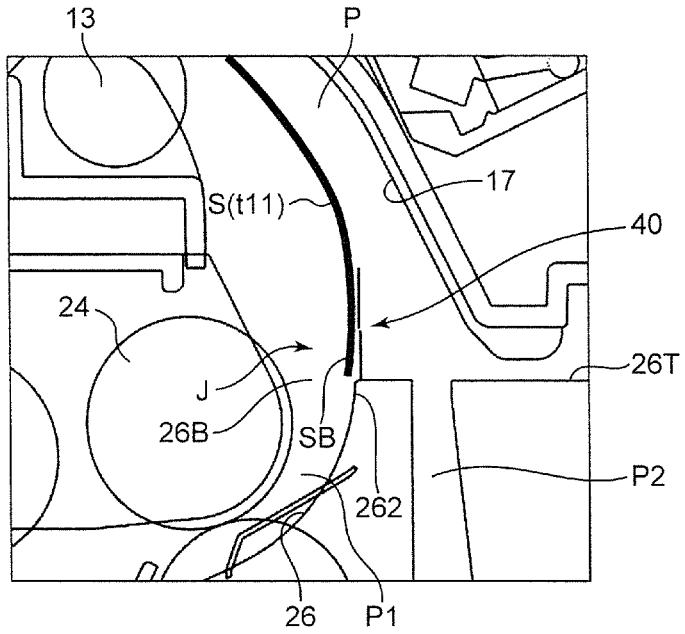
FIG. 6 is a sectional view showing the action of a movable guide according to the embodiment of the present disclosure.
Figure 7:
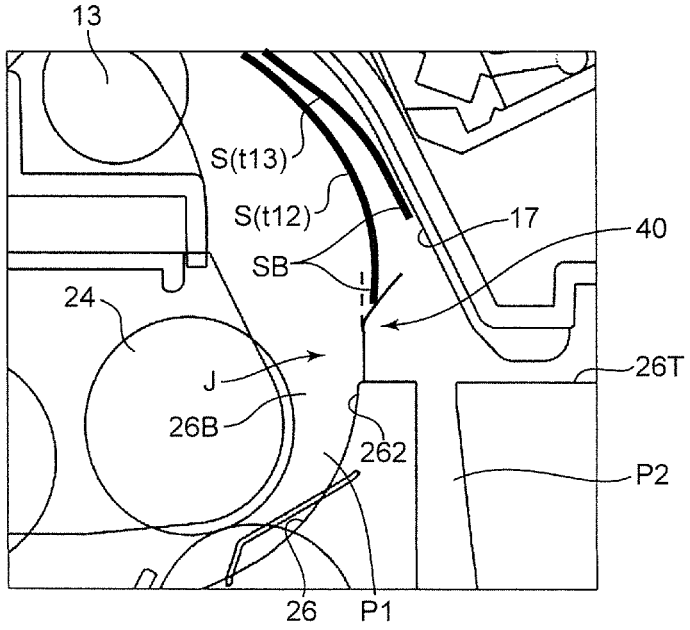
FIG. 7 is a sectional view showing the action of the movable guide.

To solve this problem, in this embodiment, a movable guide 40 for guiding the sheet S is mounted at the downstream end 26B of the first conveyance path P1 as shown in FIGS. 3, 6 and 7. The movable guide 40 is a guide standing to project into the joint section J from the ceiling plate 26T and connected to the downstream edge 262 of the curved guide plate 26 to extend the downstream end 26B of the first conveyance path P1. Further, a clearance is present between a projecting tip of the movable guide 40 and the outer guide plate 17. Thus, the movable guide 40 neither closes the downstream end 27B of the second conveyance path P2 nor obstructs sheet conveyance along the conveyance path C2 at all. Further, the movable guide 40 has an elastic tip side and can be deformed by being pressed by the sheet S.

By providing such a movable guide 40, the flip-up of the trailing end SB of the sheet S being conveyed along the conveyance path C1 is suppressed. As shown in FIG. 6, the trailing end SB is guided by the movable guide 40 at time t11 immediately after the trailing end SB of the sheet S passes through the downstream end 26B (see S(t11) of FIG. 6). That is, even if the trailing end SB enters the joint section J, the trailing end SB does not flip up since the movable guide 40 is standing while being connected to the curved guide plate 26.

At time t12 reached when conveyance further proceeds after time t11, the trailing end SB of the sheet S is guided by the tip side of the movable guide 40 (see S(t12) of FIG. 7). The tip side of the movable guide 40 is curved forward and the trailing end SB is close to the outer guide plate 17. Further, a degree of curvature of the sheet S is gradually reduced and the pressing force becomes weaker as the sheet S is conveyed to the horizontal intermediate part PC.

Thereafter, at time t13 reached by further conveyance, the trailing end SB passes through the movable guide 40 and is in surface contact with the outer guide plate 17 (see S(t13) of FIG. 7). The flip-up of the trailing end SB at the time of this surface contact is drastically moderate as compared with the flip-up in the state shown in FIG. 4. Thus, almost no flipping sound of the trailing end SB is produced. Note that even if the movable guide 40 is formed of a rigid member having no elasticity, it can contribute to the suppression of a flipping sound since the action thereof to narrow the conveyance width of the joint section J does not change.

Here, the cassette 20 is withdrawn forward from the front surface of the main body housing 10 for the replenishment of sheets. Thus, if the movable guide 40 is constantly standing, the movable guide 40 and the main body housing 10 interfere with each other during this withdrawing operation. To prevent this interference, the movable guide 40 is displaced to a guiding posture where it projects into the joint section J to extend the downstream end 26B of the first conveyance path P1, i.e. a projecting position where it projects into the joint section J from the downstream end 26B to guide the sheet in a mounted state where the cassette 20 is mounted in the main body housing 10 and a retracted posture where it is refracted from the joint section J without substantially projecting, i.e. a retracted position where it is substantially refracted from the joint section J in a withdrawn state where the cassette 20 is withdrawn from the main body housing 10. A configuration for this posture change of the movable guide 40 is described below.

Figure 8:
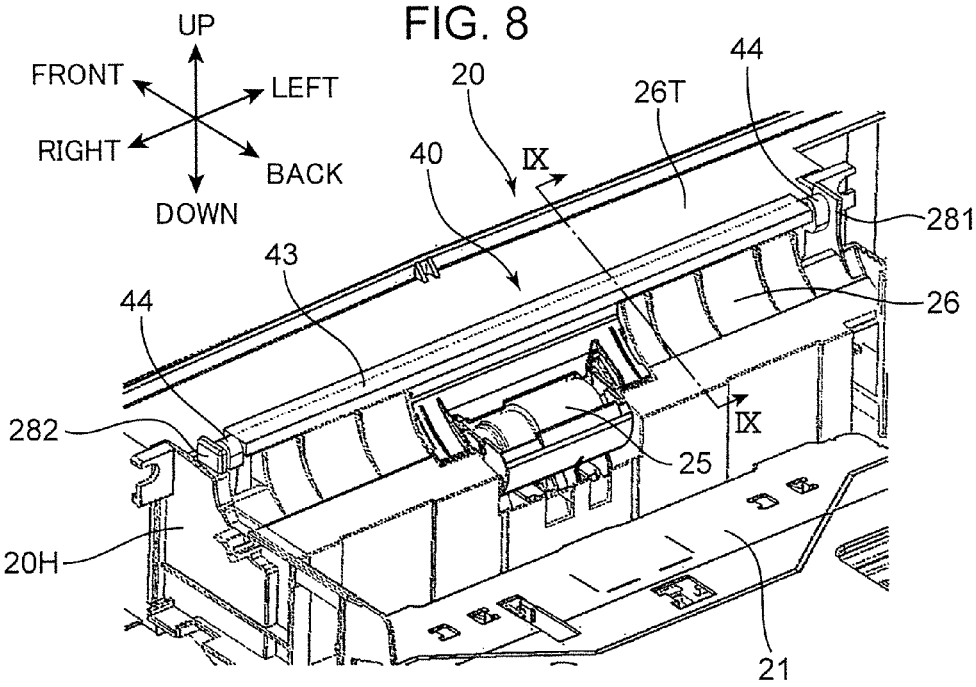
FIG. 8 is a perspective view of a cassette showing a state where the movable guide is in a retracted posture.
Figure 9:
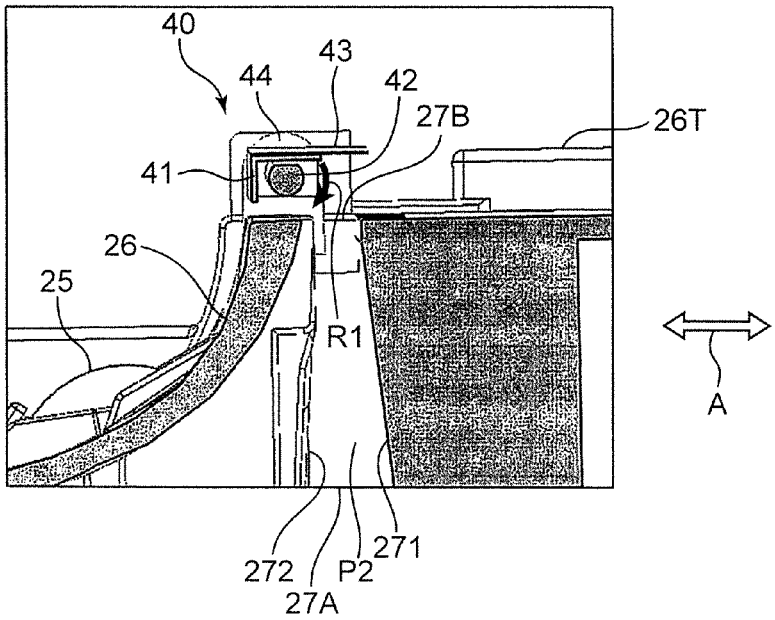
FIG. 9 is a sectional view along line IX-IX of FIG. 8.
Figure 10:
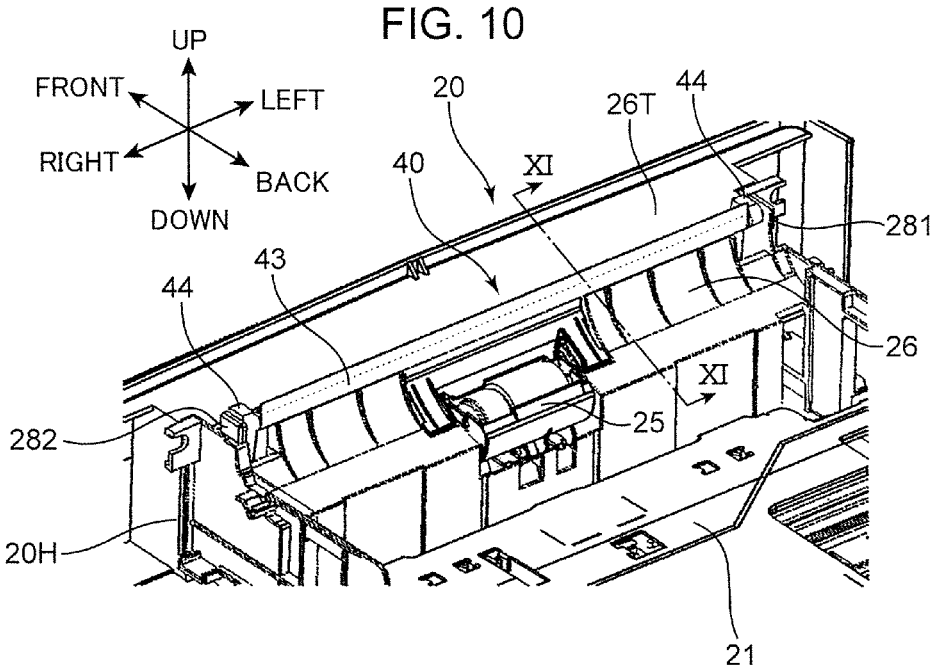
FIG. 10 is a perspective view of the cassette showing a state where the movable guide is a guiding posture.
Figure 11:
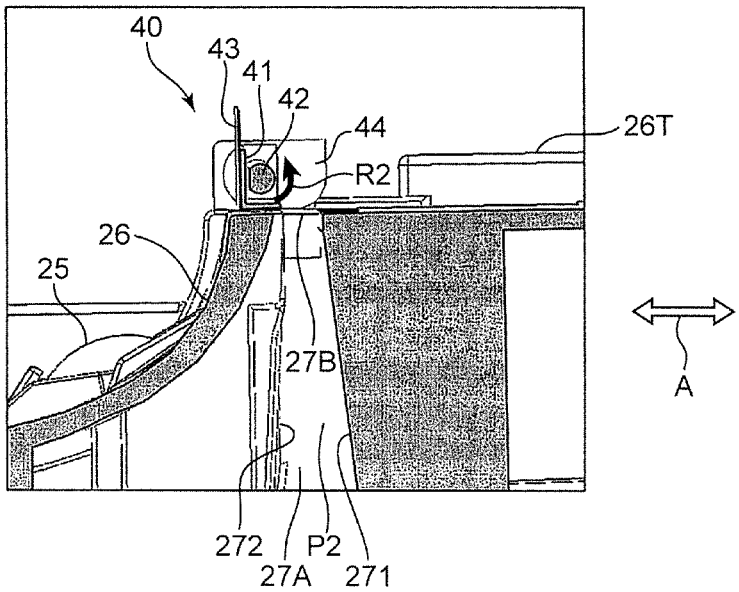
FIG. 11 is a sectional view along line XI-XI of FIG. 10, FIGS. 12A and 12B are perspective views of the movable guide.
Figure 12A:
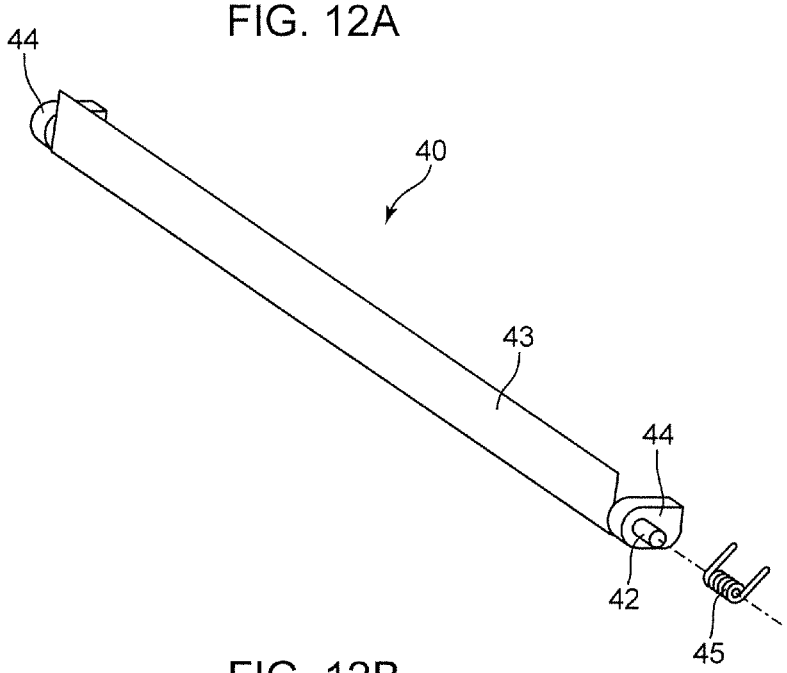
Figure 12B:
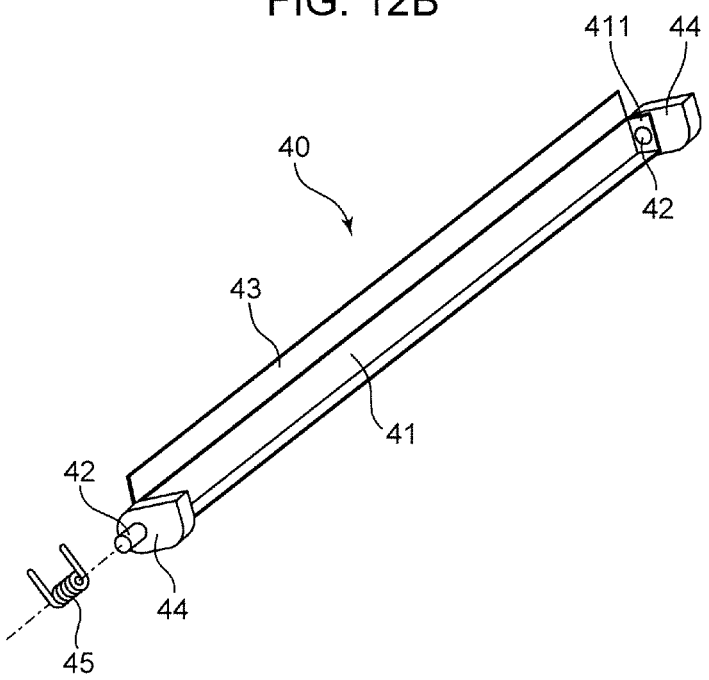

FIG. 8 is a perspective view of the cassette 20 showing the state where the movable guide 40 is in the retracted posture, and FIG. 9 is a sectional view along line IX-IX of FIG. 8. FIG. 10 is a perspective view of the cassette 20 showing a state where the movable guide 40 is in the guiding posture, and FIG. 11 is a sectional view along line XI-XI of FIG. 10. FIGS. 12A and 12B are perspective views of the movable guide 40 alone.

First, the structure of the movable guide 40 is described with reference to FIGS. 12A and 12B. The movable guide 40 includes a holding frame 41 made of a metal plate (may also a rigid resin plate), shaft portions 42 which serve as a pivot of this holding frame 41 and an elastic guide film 43 held by the holding frame 41.

The holding frame 41 is a rigid plate-like member long in a width direction of the sheet being conveyed (direction perpendicular to the sheet conveying direction). Bent portions 411 are formed on opposite ends in a longitudinal of the holding frame 41. The shaft portions 42 are cylindrical bodies extending in a direction parallel to the longitudinal direction from outer side surfaces of the respective bent portions 411. The holding frame 41 and the guide film 43 held thereby integrally rotate about the shaft portions 42.

The guide film 43 is, for example, a resin film such as a polyester film and a rectangular film whose length in the longitudinal direction is substantially equal to that of the holding frame 41 and whose length in the width direction perpendicular to the longitudinal direction is longer than that of the holding frame 41. A lower half of the guide film 43 in the width direction is adhered to the holding frame 41 and an upper half extends from the holding frame 41. This extending part of the guide film 43 is the tip side of the movable guide 40 to be curved and deformed as already shown in FIG. 7. Specifically, the extending part of the guide film 43 is deformed when the sheet passes through the movable guide 40, thereby suppressing the flip-up of the sheet trailing end.

A cam piece 44 is attached to each shaft portion 42 of the movable guide 40. The cam piece 44 is eccentrically attached to each shaft portion 42 in a state extending along the outer side surface of the bent portion 411. The shaft portion 42 includes a part projecting outward through the cam piece 44. A torsional coil spring (biasing member) is fitted on this extending part of the shaft portion 42. This torsional coil spring 45 is a member for constantly biasing the movable guide 40 toward the retracted posture.

FIG. 8 is a perspective view showing the withdrawn state where the cassette 20 is withdrawn from the main body housing 10. FIG. 9 is a sectional view along line IX-IX of FIG. 8. Note that outline arrows A of FIG. 9 indicate withdrawing and mounting directions of the cassette (the same holds true for the following drawings; hereinafter, mounting and detaching directions A). The cassette housing 20H includes a left frame 281 and a right frame 282 for rotatably supporting the shaft portions 42 located on the opposite ends in the longitudinal direction of the movable guide 40. In this embodiment, the torsional coil spring 45 is fitted on the left shaft portion 42. One end part of a coil of the torsional coil spring 45 is locked by an unillustrated locking portion of the left frame 281, and the other end part of the coil is locked by an unillustrated locking portion provided near the left end of the movable guide 40.

In this withdrawn state, the movable guide 40 is in the refracted posture where it is laid down to extend along the mounting and detaching directions A. That is, the movable guide 40 is laid down along the ceiling plate 26T of the cassette housing 20 and does not project upward from the ceiling plate 26T. This is because the movable guide 40 is biased to rotate in a direction of an arrow R1 (second direction) of FIG. 9 about the shaft portions 42. Thus, the movable guide 40 does not interfere with the main body housing 10 when the cassette 20 is withdrawn from or mounted into the main body housing 10 in the detaching or mounting direction A, and this operation is not obstructed. Further, the laid-down movable guide 40 closes the downstream end 27B of the second conveyance path P2 from above, thereby also functioning to prevent the entrance of foreign substances and dust into the second conveyance path P2.

Next, FIGS. 10 and 11 are perspective views showing the mounted state where the cassette 20 is mounted in the main body housing 10. In the mounted state, the movable guide 40 is in the guiding posture where it projects in a direction perpendicular to the mounting and detaching directions A. This guiding posture is a posture where the movable guide 40 projects into the joint section J to be connected to the downstream end 26B of the first conveyance path P1 and can guide a sheet dispensed from the first conveyance path P1 as shown in FIGS. 6 and 7. A posture change from the retracted posture to this guiding posture is realized by the rotation of the movable guide 40 by about 90° in a direction of an arrow R2 (first direction) of FIG. 11 about the shaft portions 42 against a biasing force of the torsional coil spring 45.

As described above, the movable guide 40 changes the posture between the guiding posture and the retracted posture by being rotated about the shaft portions 42 (pivot). Accordingly, the posture of the movable guide 40 can be simply and easily changed. Such a posture change is performed in association with the mounting and detaching operations of the cassette 20 into and from the main body housing 10. This point is described based on FIGS. 13 to 16.

Figure 13:
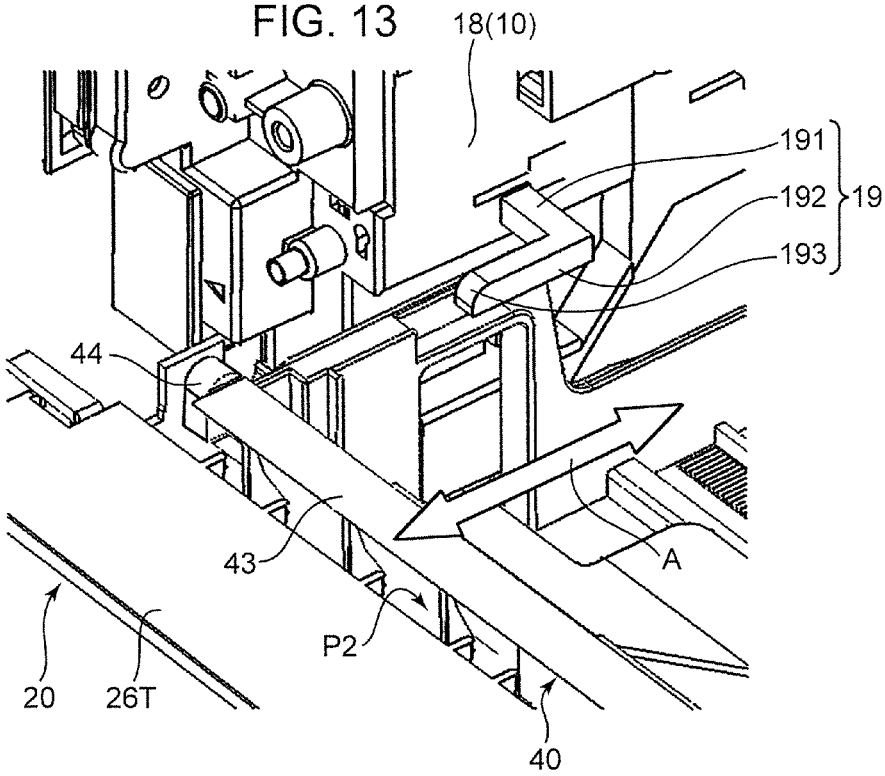
FIG. 13 is a perspective view showing a state where the cassette is withdrawn from an apparatus main body.
Figure 14:
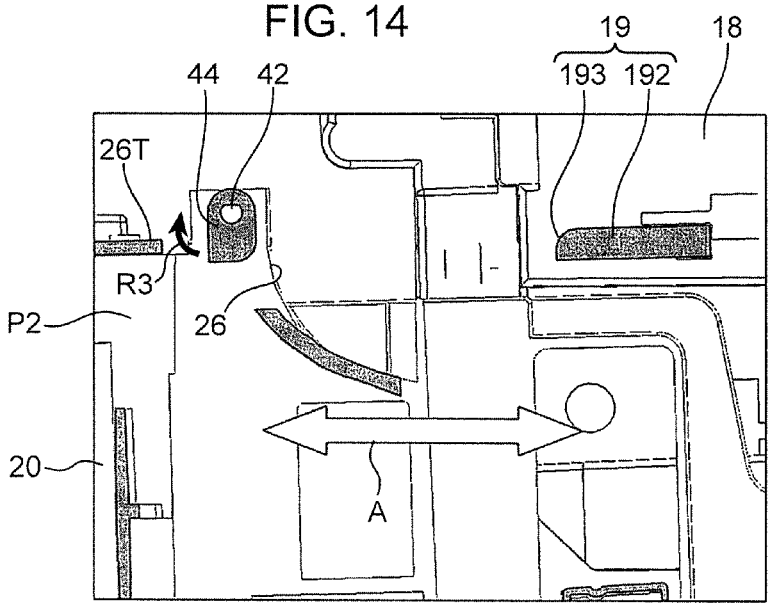
FIG. 14 is a side sectional view of FIG. 13.

FIG. 13 is a perspective view showing the withdrawn state where the cassette 20 is withdrawn from the main body housing 10, and FIG. 14 is a side sectional view of FIG. 13. The main body housing 10 includes a vertical frame 18 partitioning a mounting space for the cassette 20. A projection 19 which interferes with the cam piece 44 of the movable guide 40 in the mounted state of the cassette 20 projects from this vertical frame 18. The projection 19 is an L-shaped member including a base portion 191 projecting into the mounting space from the vertical frame 18, an interfering portion 192 connected to the tip of the base portion 191 and extending along the mounting and detaching directions A and a curved tip portion 193 formed on the tip of the interfering portion 192.

As shown in FIG. 14, the interfering portion 192 is at a height position below the shaft portions 42 in a state where the cassette 20 is properly mounted into the mounting space of the main body housing 10. The curved tip portion 193 is facing a part of the cam piece 44 below the shaft portion 42 in the mounting direction. In the withdrawn state, the cam piece 44 and the projection 19 do not interfere with each other and the movable guide 40 is set in the retracted posture by the biasing force of the torsional coil spring 45 as described above. A longer axis of the cam piece 44 extends in the vertical direction in this retracted posture.

Figure 15:
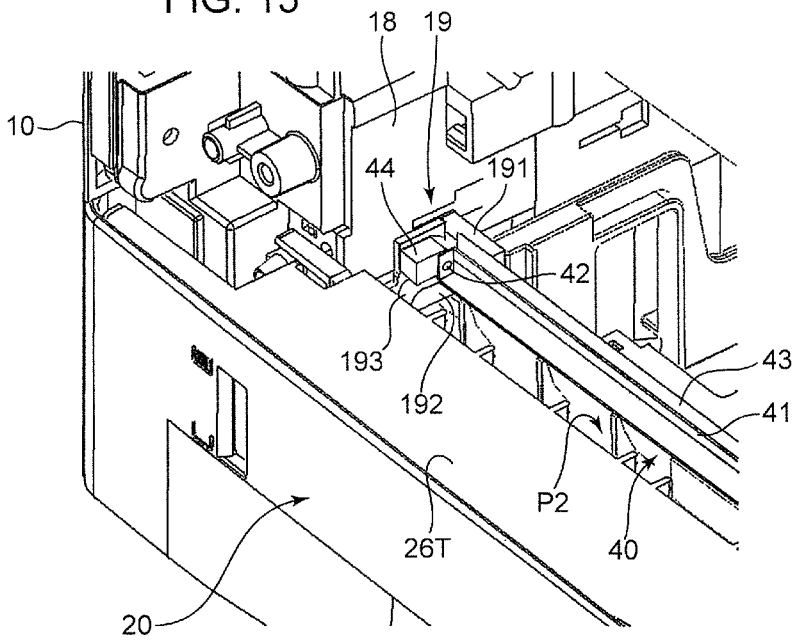
FIG. 15 is a perspective view showing a state where the cassette is mounted in the apparatus main body.
Figure 16:
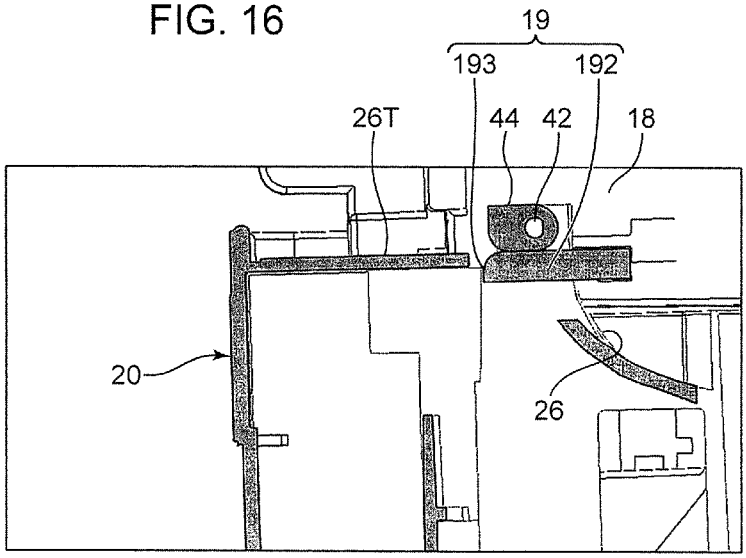
FIG. 16 is a side sectional view of FIG. 15.

FIG. 15 is a perspective view showing the mounted state where the cassette 20 is mounted in the main body housing 10 and FIG. 16 is a side sectional view of FIG. 15. The cam piece 44 and the projection 19 interfere with each other when the cassette 20 is set in the mounted state. Specifically, the interfering portion 192 slips under the shaft portion 42. As the cassette 20 is inserted into the mounting space of the main body housing 10, the curved tip portion 193 of the interfering portion 192 eventually comes into contact with the part of the cam piece 44 below the shaft portion 42.

As the cassette 20 is further inserted, the cam piece 44 is pressed by the curved tip portion 193 and rotates in a direction of an arrow R3 of FIG. 14 about the shaft portion 42 against the biasing force of the torsional coil spring 45. When the cassette 20 is mounted at a predetermined position in the mounting space, the curved tip portion 193 passes the shaft portion 42 and the interfering portion 192 supports the cam piece 44 from below. At this time, the cam piece 44 rotates by 90° and a shorter axis thereof extends in the vertical direction.

When the cam piece 44 rotates about the shaft portion 42, the movable guide 40 integral to the cam piece 44 also rotates. Accordingly, the movable guide 40 changes the posture from the retracted posture to the guiding posture as the cam piece 44 rotates. Note that if the cassette 20 in the mounted state is withdrawn from the main body housing 10 to a certain extent and the interfering portion 192 (curved tip portion 193) is separated from the cam piece 44, the cam piece 44 rotates in a direction opposite to the arrow R3 due to the biasing force of the torsional coil spring 45. This causes the cam piece 44 to return to a posture where the longer axis extends in the vertical direction, and the movable guide 40 changes the posture from the guiding posture to the retracted posture.

As just described, the movable guide 40 is in the guiding posture against the biasing force of the torsional coil spring 45 due to the interference of the cam piece 44 and the projection 19 in the mounted state. On the other hand, the cam piece 44 and the projection 19 no longer interfere with each other and the movable guide 40 is set in the retracted posture in the withdrawn state. In addition, this posture change of the movable guide 40 has an advantage that a user needs not particularly intentionally perform this operation and the posture of the movable guide 40 is automatically and reliably changed in association with the mounting and detaching operations of the cassette 20 into and from the main body housing 10.

Figure 17:
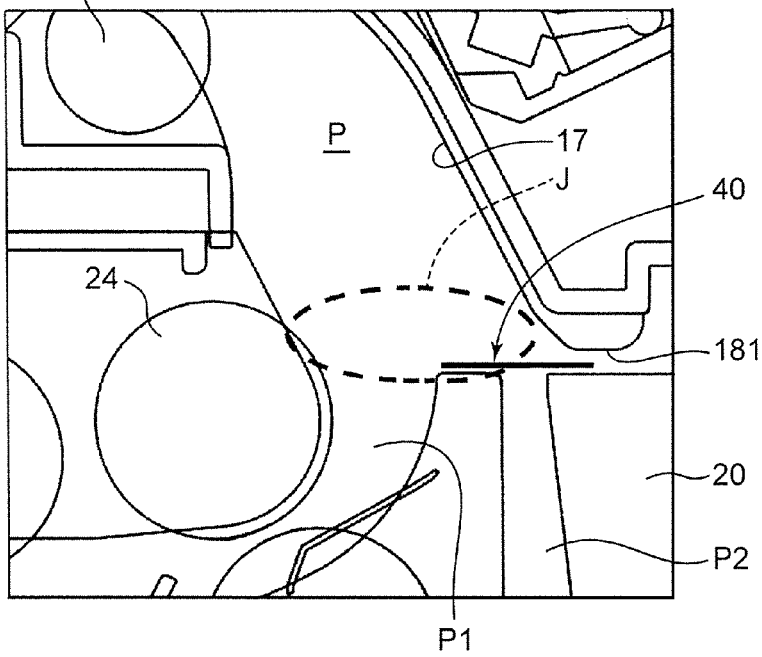
FIG. 17 is a sectional view showing a posture change timing of the movable guide.
Figure 18:
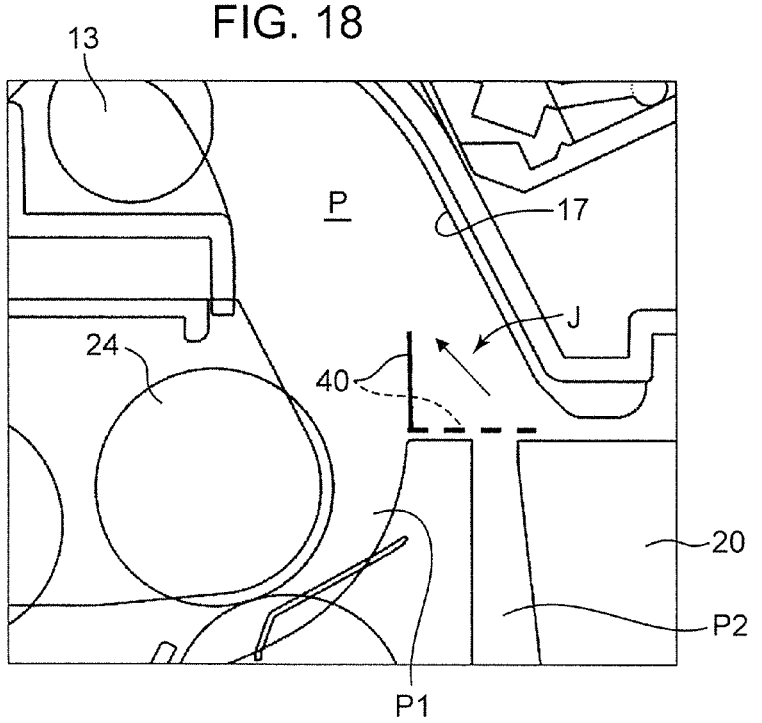
FIG. 18 is a sectional view showing the posture change timing of the movable guide.

FIGS. 17 and 18 are sectional views showing a posture change timing of the movable guide 40. The cam piece 44 and the projection 19 are arranged at such positions that the posture of the movable guide 40 is changed from the retracted posture to the guiding posture at a timing at which the cassette 20 in the withdrawn state is mounted to a correct position in the mounting space of the main body housing 10 (predetermined position in the apparatus main body), specifically at a timing at which the mounting of the cassette 20 into the main body housing 10 is completed.

FIG. 17 shows a state immediately before the mounting of the cassette 20 into the main body housing 10 is completed. In this state immediately before completion, the movable guide 40 is not standing. That is, the projection 19 is not rotating the cam piece 44 in the direction of the arrow R3. Accordingly, the movable guide 40 can be introduced to the position of the joint section J without interfering with a frame 181 and the like defining the upper surface of the mounting space of the main body housing 10.

FIG. 18 shows a state where the mounting of the cassette 20 into the main body housing 10 is completed. In this completed state, the movable guide 40 is standing and projecting into the joint section J. The cam piece 44 and the projection 19 are arranged at such positions (interfering positions) that the movable guide 40 stands at a timing at which this completed state is reached, i.e. at a timing at which the tip of the movable guide 40 reaches an area of the joint section J through the frame 181. This enables the movable guide 40 to reliably project into the joint section J without interfering with the main body housing 10.

According to this embodiment described above, the flip-up of a sheet in the joint section J can be suppressed by the movable guide 40 in the printer 1 including the joint section J where the first and second conveyance paths P1, P2 join. Specifically, the cassette 20 includes the movable guide 40 capable of extending the downstream end 26B of the first conveyance path P1 by projecting into the joint section J. This can narrow the conveyance width in the joint section J by the movable guide 40 and suppress the flip-up of a trailing end of a sheet in the conveying direction. Thus, a noise reduction of the printer 1 can be realized. Further, the movable guide 40 substantially does not project in the state where the cassette 20 is withdrawn from the main body housing 10. Therefore, there is an advantage of not affecting the withdrawal of the cassette 20 from the main body housing 10.

Although one embodiment of the present disclosure has been described above, the present disclosure is not limited to this. For example, the following modifications may be adopted.

(1) An example in which the movable guide 40 is returned to the retracted posture by the biasing force of the torsional coil spring 45 is illustrated in the above embodiment. Instead of the torsional coil spring 45, another biasing member such as a leaf spring or a coil spring may be used. Alternatively, the biasing member may be omitted and the movable guide 40 may be returned to the retracted posture by the own weight thereof or by attaching a weight member thereto.

(2) An example in which the posture of the movable guide 40 is changed between the guiding posture and the retracted posture by the rotation of the movable guide about the shaft portions 42 is illustrated in the above embodiment. Instead of this, the movable guide 40 may be set in the retracted posture, for example, by being retracted into the cassette housing 20H.

(3) An example in which the posture of the movable guide 40 is changed in association with the mounting and detachment of the cassette 20 due to the interference of the cam piece 44 and the projection 19 is illustrated in the above embodiment. This is one example and any mechanism for causing the movable guide 40 to project into the joint section J when the cassette 20 is in the mounted state and laying down the movable guide 40 when the cassette 20 is withdrawn from the main body housing 10 can be adopted.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an apparatus main body that includes an image forming unit for applying an image forming process to a sheet and a main conveyance path for conveying the sheet by way of the image forming unit;

a first storage portion which is withdrawably mounted into the apparatus main body and includes a storage portion for sheets and a first conveyance path for conveying the sheets from the storage portion toward the main conveyance path;

a second conveyance path that conveys a sheet from a second storage portion for sheets other than the sheets in the first storage portion toward the main conveyance path;

a joint section where an upstream end of the main conveyance path and downstream ends of the first and second conveyance paths join; and a movable guide mounted to the first storage portion at the downstream end of the first conveyance path for guiding a sheet;

the movable guide contacting a portion of the apparatus main body as the first storage portion is mounted in the apparatus main body and being displaced relative to the first storage portion to a projecting position where the movable guide projects toward the joint section from the downstream end of the first conveyance path to guide the sheet and the movable guide being displaced to a retracted position substantially retracted from the joint section as the first storage portion is withdrawn from the apparatus main body.

2. An image forming apparatus according to claim 1, wherein:

at least a part of the main conveyance path near the upstream end of the main conveyance path is a vertically extending conveyance path;

the second storage portion is arranged below the first storage portion; and a conveyance path from the first conveyance path to the vicinity of the upstream end of the main conveyance path is a conveyance path curved into an L shape and a conveyance path from the second conveyance path to the vicinity of the upstream end of the main conveyance path is a vertically extending conveyance path.

3. An image forming apparatus according to claim 2, wherein:

the downstream end of the second conveyance path is formed by a guide plate provided in the first storage portion; and the downstream end of the first conveyance path and the downstream end of the second conveyance path are juxtaposed in a withdrawing direction of the first storage portion and respectively connected to the joint section.

4. An image forming apparatus according to claim 1, wherein the movable guide:

includes a plate-like holding frame long in a width direction of sheets to be conveyed, a guide film supported on the holding frame and a pivot for rotating the holding frame about an axis extending in a longitudinal direction of the holding frame;

is set in a guiding posture where the guide film projects into the joint section to be connected to the downstream end of the first conveyance path by the movable guide rotating about the pivot in a first direction in the mounted state; and is set in a retracted posture where the movable guide rotates in a second direction opposite to the first direction about the pivot and the guide film no longer projects in the withdrawn state.

5. An image forming apparatus according to claim 4, wherein:

the guiding posture is a posture where the guide film projects in a direction perpendicular to a withdrawing direction of the first storage portion; and the retracted posture is a posture where the guide film is laid down along the withdrawing direction of the first storage portion.

6. An image forming apparatus according to claim 4, wherein:

the first storage portion further includes a biasing member configured to bias the movable guide toward the retracted posture and a cam piece attached to the pivot;

the apparatus main body includes a projection which interferes with the cam piece in the mounted state of the first storage portion; and the movable guide is set in the guiding posture against a biasing force of the biasing member due to the interference of the cam piece and the projection in the mounted state while being set in the retracted posture by eliminating the interference in the withdrawn state.

7. An image forming apparatus according to claim 6, wherein:

the cam piece and the projection are arranged at such positions that the posture of the movable guide is changed from the retracted posture to the guiding posture at a timing at which the first storage portion is mounted at a predetermined position in the apparatus main body from the withdrawn state.

* * * * *